US007059945B2

(12) United States Patent
Skinner

(10) Patent No.: US 7,059,945 B2
(45) Date of Patent: Jun. 13, 2006

(54) PIPE WELD CLEANING MACHINE

(75) Inventor: Donald P. Skinner, Conroe, TX (US)

(73) Assignee: Offshore Joint Services, Inc., Katy, TX (US)

( * ) Notice: Subject to any disclaimer, the term of this patent is extended or adjusted under 35 U.S.C. 154(b) by 184 days.

(21) Appl. No.: 10/857,189

(22) Filed: May 28, 2004

(65) Prior Publication Data

US 2005/0266779 A1 Dec. 1, 2005

(51) Int. Cl.
*B08B 9/02* (2006.01)

(52) U.S. Cl. ..... 451/91; 451/92; 15/88; 118/307; 134/180

(58) Field of Classification Search ..... 451/92, 451/91, 441; 15/88, 104.04, 93.1, 93 R; 118/307, 323; 134/180, 172
See application file for complete search history.

(56) References Cited

U.S. PATENT DOCUMENTS 3,641,608 A * 2/1972 Kratt ..... 15/88
4,007,705 A * 2/1977 Sherer et al. ..... 118/710
4,552,594 A * 11/1985 van Voskuilen et al. ..... 134/34
4,909,669 A 3/1990 Baker
4,961,798 A * 10/1990 Hart et al. ..... 156/86
5,001,801 A * 3/1991 Jarvis et al. ..... 15/93.1
5,069,234 A * 12/1991 Nielsen ..... 134/113
5,226,973 A * 7/1993 Chapman et al. ..... 134/34
5,238,331 A * 8/1993 Chapman ..... 405/303
5,328,648 A 7/1994 McBrien et al.
5,520,734 A * 5/1996 Taylor et al. ..... 118/307
5,720,070 A * 2/1998 Kelley et al. ..... 15/88
5,804,093 A 9/1998 Wyke et al.
5,900,195 A 5/1999 Pool et al.
6,402,201 B1 6/2002 Pool et al.

* cited by examiner

*Primary Examiner*—Lee D. Wilson
*Assistant Examiner*—Anthony Ojini
(74) *Attorney, Agent, or Firm*—Bracewell & Giuliani LLP

(57) ABSTRACT

A pipe joint between welded exposed metal end sections of coated pipe being formed into a pipeline is cleaned before a corrosion resistant film is applied. A cleaning head of a cleaning mechanism is placed with a mounting frame on the pipe in the area of the pipe ends to be cleaned. The cleaning head moves in a succession of longitudinal cleaning passes in the direction of the longitudinal axis of the pipe area being cleaned. The frame also moves the cleaning head rotatably with respect to the pipe joint to positions for the longitudinal cleaning passes. A control mechanism defines the extent of the longitudinal cleaning passes, and also controls movement of the cleaning head to successive cleaning passes until the pipe joint is cleaned. The control is programmed and automatic, and there is no need for contact with the mechanism while it is in operation. The number of cleaning heads and cleaning material supply and exhaust hoses or tubes, as well as the number of crew required, is reduced.

18 Claims, 7 Drawing Sheets

PIPE WELD CLEANING MACHINE

BACKGROUND OF THE INVENTION

1. Field of the Invention

The present invention relates to cleaning portions of pipe in the areas where adjacent end sections of pipe have been welded together to form a pipeline or the like. More specifically, the present invention provides a new and improved pipe weld cleaner and control mechanism to regulate and control movement of a cleaning head as it moves along and about the welded pipe end portions while cleaning those end portions after they have been welded together.

2. Description of the Related Art

Pipelines have been for a number of years laid on the submerged floors of bodies of water from pipe laying barges. On the pipe-laying barge, the pipeline length was formed by welding successive lengths or sections of pipe sequentially in an end-to-end fashion to previously welded sections at an end portion of the pipeline. The pipe sections were typically covered with concrete or some other protective coating along their lengths except for the exposed metal end sections. The welded sections extended from the pipe-laying barge into the body of water and were laid or deposited in or on the floor of the body of water. After a length of pipe was welded to the end of the pipeline, and before its entry into the body of water, it has been the practice to clean the areas where the weld occurred so that a corrosion-resistant coating or film of a suitable synthetic resin could be applied. It was also typical after application of the corrosion coating film to apply a protective coating over the corrosion resistant film. U.S. Pat. Nos. 4,909,669; 5,328,648; 5,804,093; 5,900,195 and 6,402,201, owned by the assignee of the present application, are examples of end portion protective covers or coatings for such a purpose.

So far as is known, previous machines for pipe cleaning in the area of the welded ends have taken the form of a set of pipe-enclosing collar rings mounted around the circumference of the pipe. The collar rings were longitudinally spaced from each other along the pipe, with the most recently welded section located between them. One or more, usually several, blast material applicator heads and removal heads or evacuators were mounted between the collar rings at selected locations about the periphery of a section of the pipe.

The applicator heads and the removal heads were moved in a circumferential arcuate path about an incremental length of the pipe until the full circumferential extent of that section of the length of the pipe has been cleaned. These previous cleaning machines have had problems in movement control. Several crewmembers were required for each machine. In addition to an operator controlling starting and stopping of the machine, typically there were at least two other crew members involved in movement of the cleaning heads to successive sections of the pipe lengths to be cleaned. After a certain length of pipe was cleaned, the mounting rings had to be opened and moved to a new location for additional cleaning. Further, each individual blast material applicator head was provided with a separate supply hose and each individual material removal head with a separate removal hose or tube.

Thus, there were several cleaning crew members and a number of hoses in a relatively small area, where a number of applicator heads and removal heads were moving in rotary paths about the circumference of a short length of the pipe section. As a result, movement control was a problem. Also, cleaning operations were time consuming and labor intensive. In addition there were some safety concerns due to the close proximity of some of the work crew to the rotating equipment and supply hoses.

SUMMARY OF THE INVENTION

Briefly, the present invention relates to a new and improved pipe weld cleaning machine to clean a pipe joint formed at end portions of longitudinally extending joined sections of a coated pipe. A cleaning head of the pipe weld cleaning machine is provided to clean the pipe joint between the coated portions on either side of the pipe joint. A frame mounts the cleaning head in a position disposed for movement with respect to the pipe joint. The frame includes a carriage for repetitive longitudinal cleaning movements along the pipe joint during cleaning. A motor moves the cleaning head on the carriage longitudinally of the pipe joint during the longitudinal cleaning movements. Sensors are provided to detect limits of the longitudinal cleaning movements for movement control purposes.

The frame of the machine also includes structure to move the cleaning head and carriage rotatably about the circumference of the pipe to begin cycles of the repetitive longitudinal movements and sensors to detect limits of the rotatable movement of the structure moving the cleaning head and carriage.

BRIEF DESCRIPTION OF THE DRAWINGS

A better understanding of the present invention can be obtained when the detailed description set forth below is reviewed in conjunction with the accompanying drawings, in which.

DETAILED DESCRIPTION OF THE PREFERRED EMBODIMENTS

Figure 10:
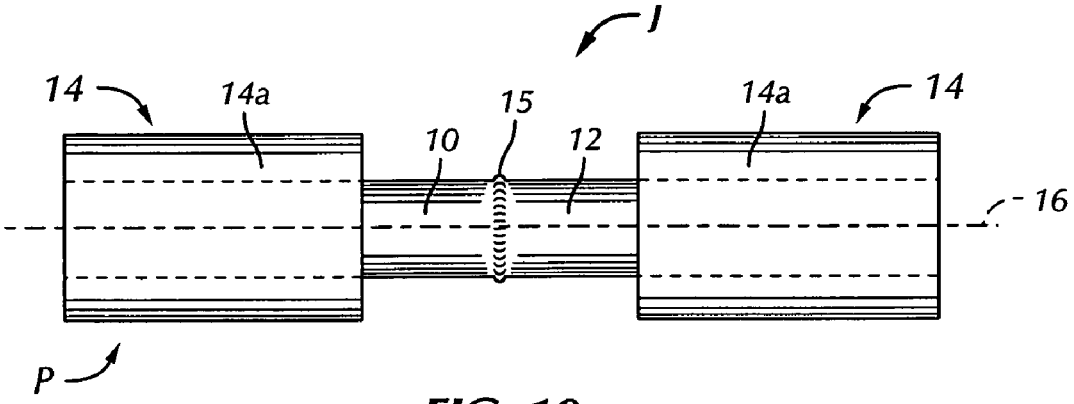
FIG. 10 (Prior Art)
FIG. 10 is a side elevation view of a metal pipe joint of the type cleaned according to the present invention

In the drawings, the letter M (FIGS. 1–3) designates generally a pipe weld cleaning machine according to the present invention. The pipe cleaning machine M is adapted to clean a metal pipe joint J (FIG. 10) formed at end portions 10 and 12 of longitudinally extending joined sections 14 of coated pipe P of the type used in pipelines on or in submerged floors of bodies of water.

Pipelines have been for a number of years laid on the submerged floors of bodies of water from pipe laying barges. On the pipe-laying barge, the pipeline length was formed by welding end portions 10 and 12 of successive lengths or sections 14 of pipe sequentially in an end-to-end fashion to previously welded sections at an end portion of the pipeline. The pipe section 14 were typically covered with concrete or some other protective coating 14*a* along their lengths except for the exposed metal end sections 10 and 12. After a length of pipe was welded to the end of the pipeline as indicated at 15, and before entry of the pipe into the body of water, it has been the practice to clean the areas where the weld 15 occurred and the end sections 10 and 12. The cleaning was done so that a corrosion-resistant coating or film of a suitable synthetic resin could be applied. It was also typical after application of the corrosion coating film to apply a protective coating over the corrosion resistant film. U.S. Pat. Nos. 4,909,669; 5,328,648; 5,804,093; 5,900,195 and 6,402,201, owned by the assignee of the present application, are examples of end portion protective covers or coatings for such a purpose. The welded sections extended from the pipe-laying barge into the body of water and were laid or deposited in or on the floor of the body of water.

Figure 1:
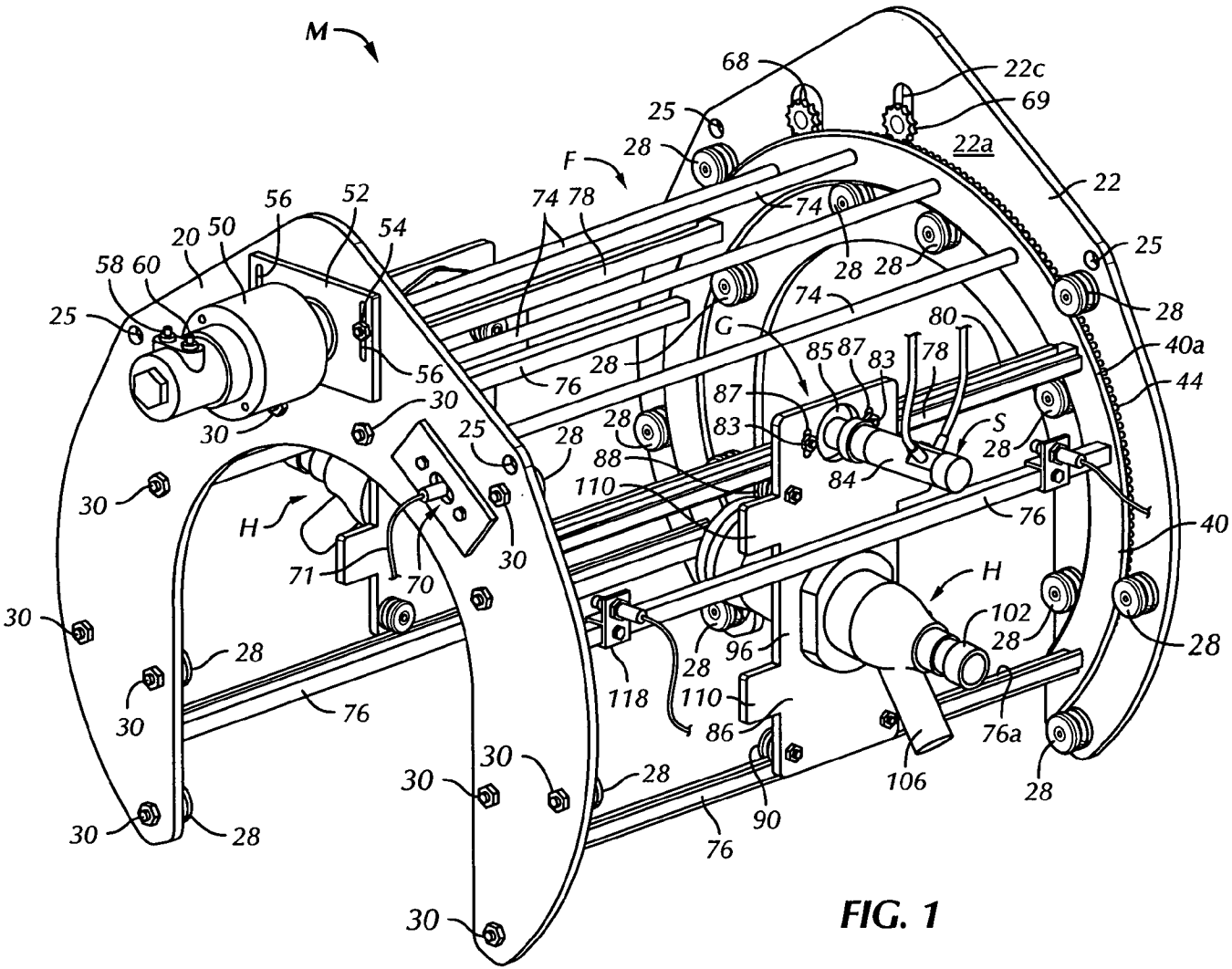
FIG. 1 is an isometric view of a pipe weld cleaning machine according to the present invention.
Figure 2:
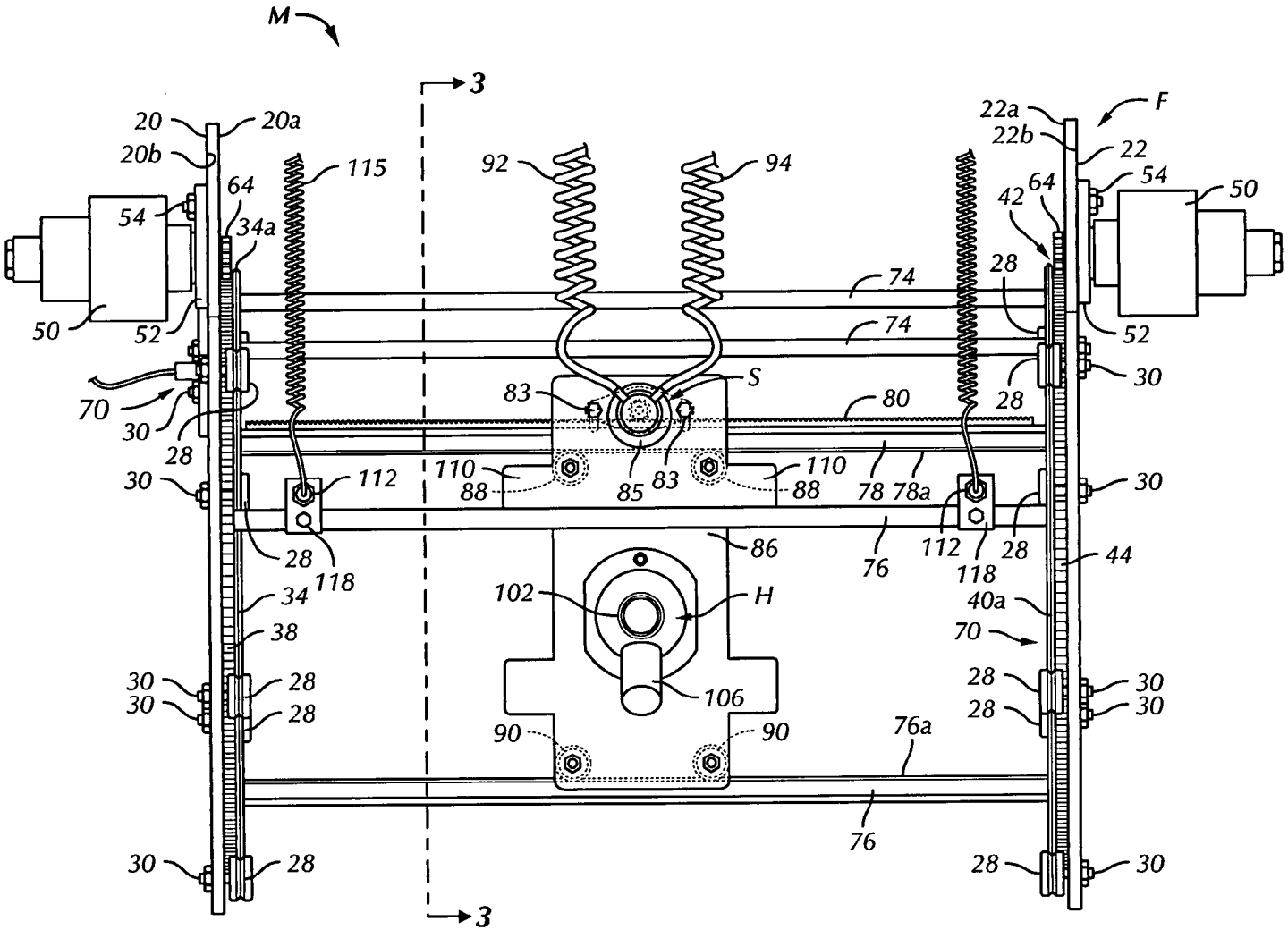
FIG. 2 is a side elevation view of the pipe weld cleaning machine of FIG. 1.
Figure 3:
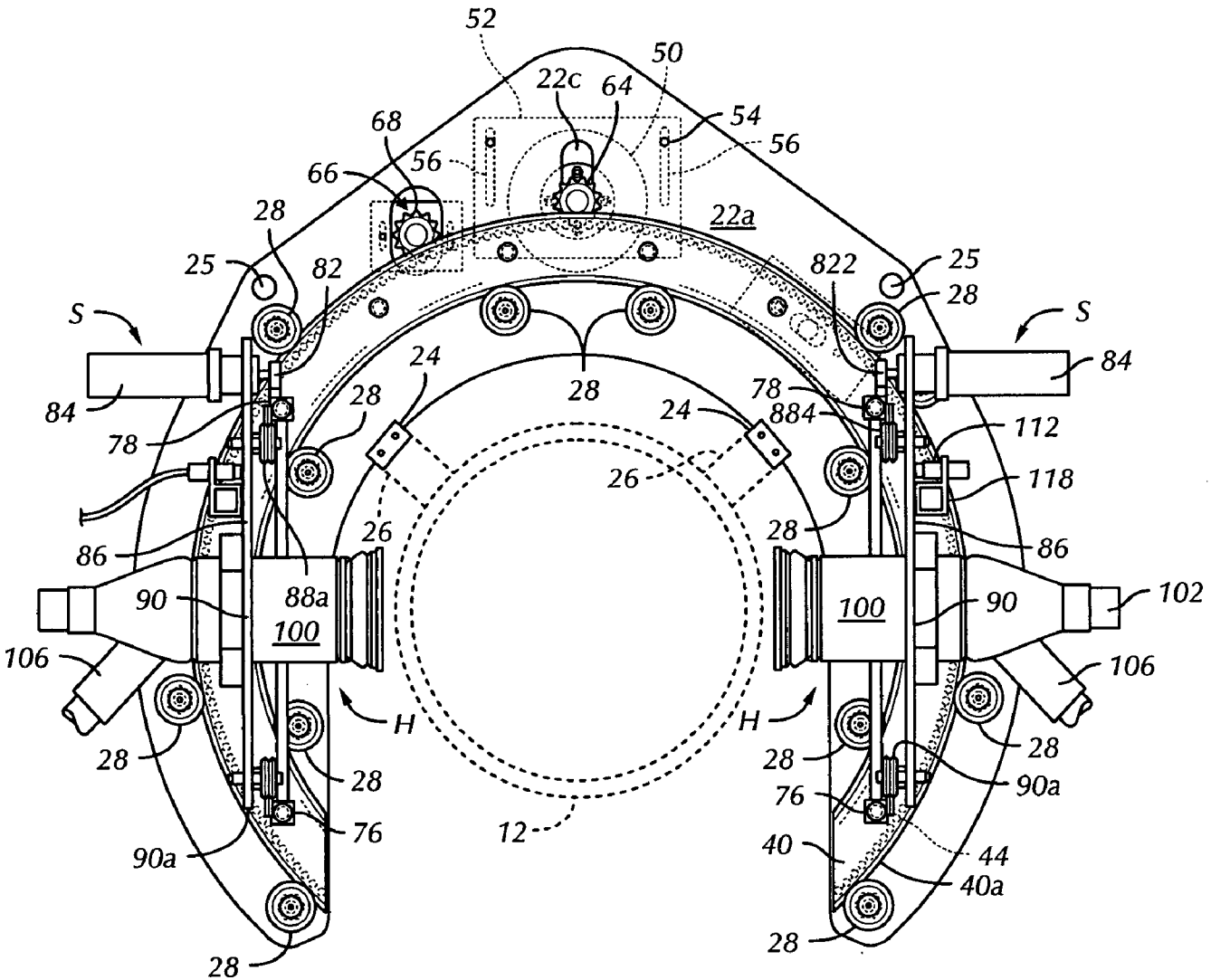
FIG. 3 is a cross-sectional view taken along the lines 3—3 of FIG. 2.
Figure 4:
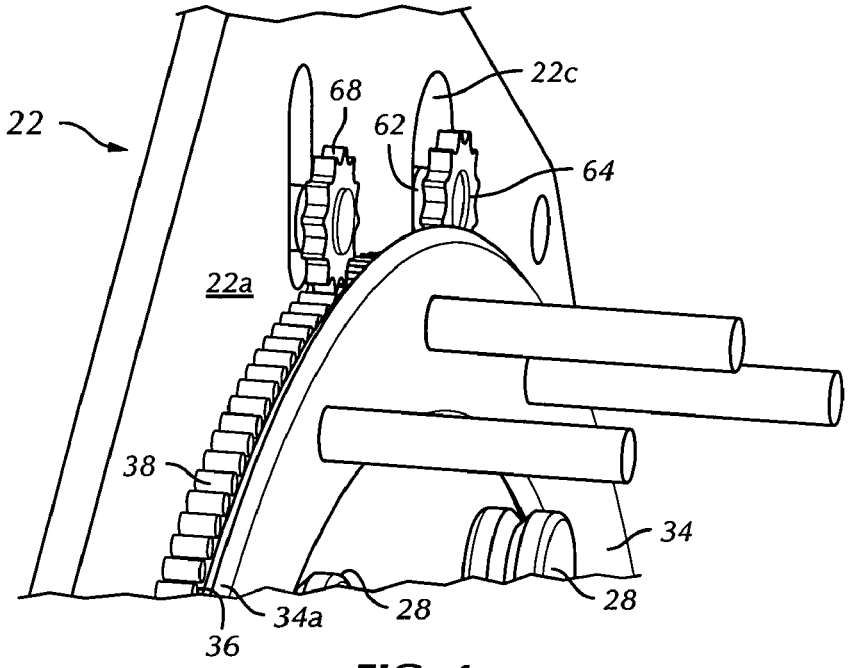
FIGS. 4 and 5 are enlarged isometric views of portions of the pipe weld cleaning machine of FIG. 1.
Figure 5:
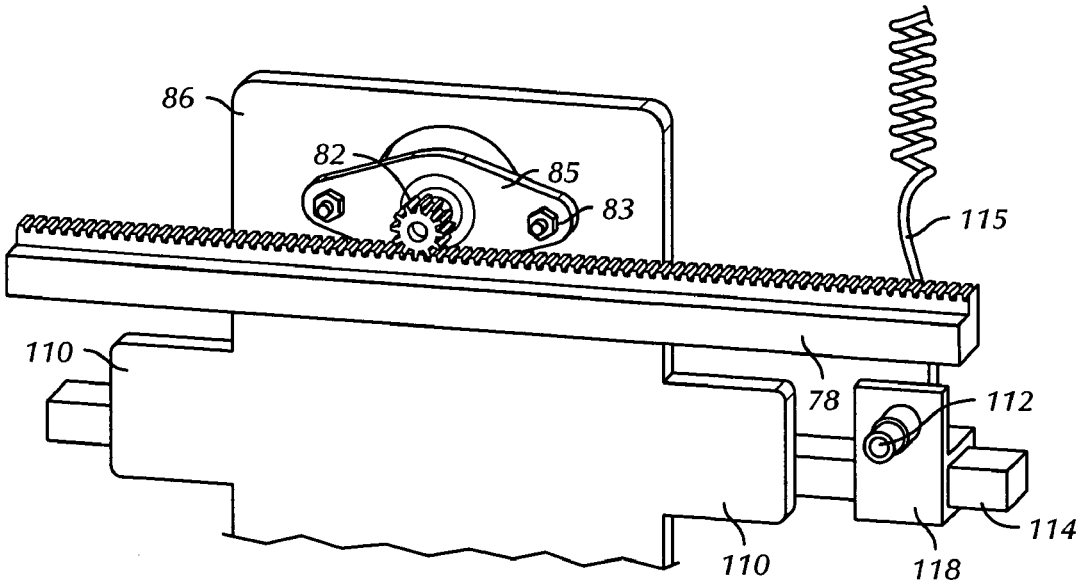
Figure 6:
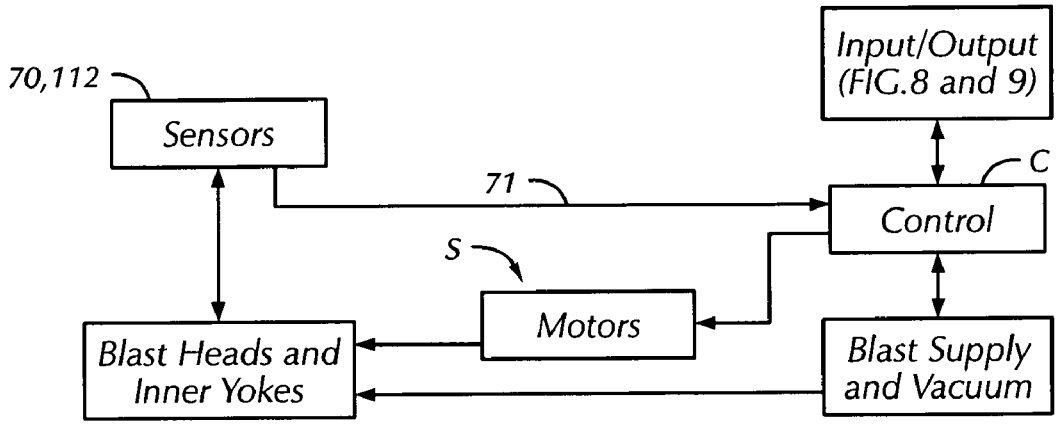
FIG. 6 is a functional block diagram of the motors and control system of the pipe weld cleaning machine of FIG. 1.
Figure 7:
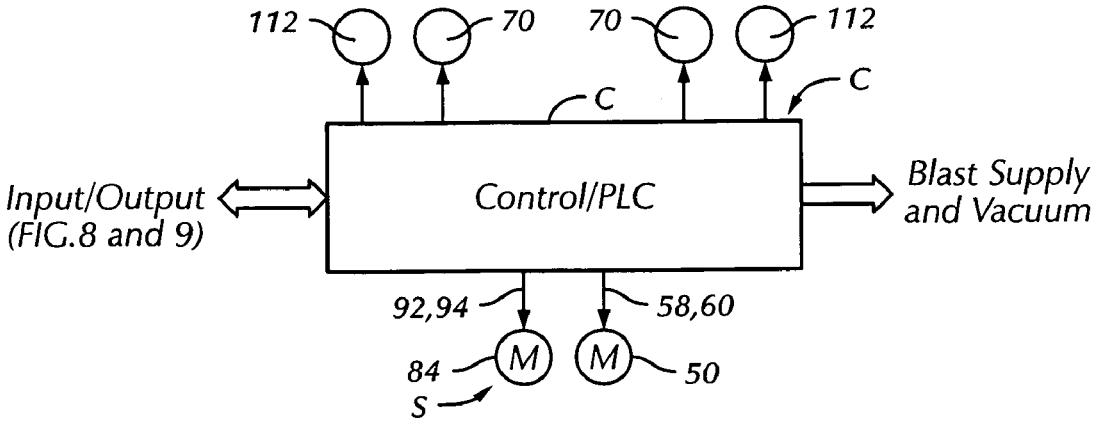
FIG. 7 is a functional block diagram of the control system of FIG. 6.

The machine M of the present invention is located on a pipe laying barge used in such pipe laying operations. The machine M according to the present invention includes at least one cleaning head H to clean the pipe joint J between the coated sections 14. Typically, as shown in FIGS. 1 and 3, a set or pair of cleaning heads H are mounted in the machine M at positions located on diametrically opposed sides of the pipe joint J. A frame F of the machine M mounts the cleaning head H in a position disposed for successive or repetitive longitudinal cleaning movements in a line parallel to a longitudinal axis 16 of the joined pipe sections 14 along the pipe joint J during such cleaning. One or more motors or power sources S of the machine M move the cleaning head H on the frame F longitudinally of the pipe joint J during the longitudinal cleaning movements. The frame F also moves the cleaning head H rotatably with respect to the pipe joint J at the end of a longitudinal cleaning movement to a new position for the next longitudinal cleaning movement to occur.

The frame F includes a first mounting ring 20 and a second mounting ring 22 located at longitudinally spaced positions from each other adjacent to the exposed metal pipe portions 10 and 12 on opposite sides of the area 15 where the pipe joint J is welded. The mounting rings 20 and 22 are generally in the form of inverted U-shaped members and are provided with a suitable number of mounting clips 24 (FIG. 3) which are adapted to receive spacer blocks 26 which rest on appropriate portions of the pipe adjacent the pipe joint J in order to support the machine M on the pipe.

Each of the mounting rings 20 and 22 are provided on their respective inner faces 20*a* and 22*a* with a suitable number of support and guide wheels 28 rotatably mounted by bolts or other attachment structure 30. The mounting rings 20 and 22 are also provided with connector eyelets or openings 25 so that suitable connectors may be attached for lifting, placement and removal of the machine M on the pipe P before and after cleaning operations.

The frame F also includes a first support yoke 34 mounted with the first mounting ring 20 to engage the support wheels 28 along an outer peripheral surface 34*a*. A gear plate 36 is mounted with the first support yoke 34 between the support yoke 34 and a first mounting ring 20. The gear plate 36 has a set of gear teeth 38 formed along an outer peripheral portion 36*a*.

Similarly, a second support yoke 40 is mounted with the second mounting ring 22 to engage support wheels 28 along an outer peripheral surface 40*a*. A gear plate 42 is mounted with the second support yoke 40 between the support yoke 40 and the second mounting ring 22. The gear plate 42 has a set of gear teeth 44 formed along an outer peripheral portion 42*a*.

The power source or motor P according to the preferred embodiment includes a rotational motor 50 for rotational movement of the support yokes 34 and 40 with respect to the mounting rings 20 and 22. Preferably, the rotational motor 50 takes the form of a pneumatic or air driven motor mounted with each of the mounting rings 20 and 22. A suitable motor can be, for example a Model No. 4AM-RV-127-GR20 air gearmotor manufactured by Gast Manufacturing, Inc. of Benton Harbor, Mich. It should be understood that air gearmotors from other sources may be used, and further that other forms of motors than pneumatic or air-driven ones can also be used. The rotational motors 50 are mounted on mounting plates 52 on outer surfaces 20*b* and 22*b* of the mounting rings 20 and 22, respectively, and may be adjustably located by mounting bolts 54 located in adjustment slots 56. Each of the motors 50 receives transfer of operating power at inlets 58 and 60 and rotates a shaft 62 mounted extending through associated slots 20*c* and 22*c* of the mounting rings 20 and 22, respectively. The shaft 62 for each of the motors 50 is rotatable in either of two directions to drive a gear 64, which engages the gear teeth 38 and 44 to cause the support yokes 34 and 40 to rotate with respect to the mounting rings 20 and 22.

A position encoder mechanism 66 is mounted with one or both of the mounting rings 20 and 22 has a rotatable gear 68 which is engageable with the associated gear teeth 38 and 44 of the gear plates 36 and 42, respectively. The position encoder or encoders 66 provide indications or signals of relative movement of the support yokes 34 and 40 to a controller C for control of relative movement and position of the support yokes 34 and 40 with respect to the mounting rings 20 and 22.

The support yokes 34 and 40 are rotated with respect to the mounting rings 20 and 22 through the action of the rotational motors 50 on the gear teeth 38 and 44. It is also to be noted that there is no direct connection between the support yokes and mounting ring at each end of the machine M, eliminating interference between their respective relative movement. If desired, the rotational motors 50 may be provided with a sprocket and the support yokes provided with a chain around their circumference as an alternative.

A rotational limit sensor or proximity switch 70 is mounted with one or both of the mounting rings 20 and 22 to sense rotational limits of the cleaning head H with respect to the pipe joint J and provide limit sense signals or movement indications over conductors 71 to the controller C. Such signals indicate that a rotational limit of movement of the support yokes 34 and 40 with respect to the mounting rings 20 and 22 has been reached. The rotational limit sensor 70 may be an optical, metallic, magnetic or other suitable sensor to sense the presence of a corresponding optical, metallic, magnetic or other target located on the support yokes 34 and 40 at the limit of relative rotational travel of the support yokes 34 and 40 in either direction with respect to the support rings 20 and 22. When the rotational limit sensor 70 detects a limit of relative rotational travel, an indication or signal is provided to the controller C to stop operation of the rotational motors 50 so that the direction of relative rotation can be reversed.

The support yokes 34 and 40 are connected together by a suitable number of connector rods or bars 74 extending between inner faces 34*a* and 40*a* of the support yokes 34 and 40, respectively. A carriage G of the frame F in the form of a number of carriage rods or beams 76 is also mounted between the surfaces 34*a* and 40*a* of the support yokes 34 and 40 for mounting the cleaning head H on the frame F.

An upper carriage rod 78 has a rack gear 80 (FIGS. 1–3, 5) mounted extending between the mounting rings 34 and 40 on opposite sides of the longitudinal axis of the pipeline and the external surface of the pipe joint J being cleaned.

The rack gears 80 (FIG. 5) of the machine M are engaged by gears 82 of a longitudinal motor 84 of the power source P on each side of the pipe joint J. The longitudinal motors 84 each move the cleaning head H on the carriage G longitudinally of the pipe joint J during the longitudinal cleaning movement of the cleaning head H. A suitable motor for the longitudinal motor 84 may be, for example, a Model 31 MR-917 Buckeye® Motor from Cooper Tools of Lexington, S.C. It should be understood that pneumatic motors from other sources may be used, and that other forms of motors than pneumatic or air-driven one can also be used. It should also be understood that rather than a gear drive for longitudinal movement, a chain or wire rope drive mechanism may instead be used. Each longitudinal motor 84 is mounted for adjustable positioning on the motor support plate 86 by suitable mounting structure. An example as shown may take the form of a mounting plate 85 and connector bolts 83 or other suitable attachment devices extending through adjustable slots 87 formed in the motor support plate 86.

A set of movement wheels or rollers, including an upper roller set 88 and a lower roller set 90, are mounted with the motor support plate 86 for allowing longitudinal movement of the motor 84 along the carriage G. The movement wheels in the roller sets 88 and 90 engage and are supported by upper carriage rod 78 and a lower carriage rod 76 of the carriage G. Preferably, the movement wheels of the roller sets 88 and 90 have grooved surfaces 88*a* and 90*a* formed therein to rest and ride upon rail portions 78*a* and 76*a* of the respective carriage rods 78 and 76. The amount and direction of movement of the cleaning head H is controlled by signals and power furnished to the motors 84 over conductors or connectors 92 and 94.

The mounting support plate 86 further has a blast applicator head or cover 100 of the cleaning head H mounted at a central portion 96 thereof. The cleaning head H may be one of several conventional, commercially available types, such as a Model PBV08-2 from VacuBlast International of Berkshire, England. The blast applicator head 100 applies abrasive or other suitable cleaning particles provided by the cleaning head H to the pipe joint J being cleaned. The abrasive particles are provided at a connector joint 102 under pressure of air or other suitable gas through a pipe or conduit from a supply source for cleaning purposes. The abrasive particles from the blast applicator head 100 contact the pipeline joint J being cleaned. The cleaning head H may also take other forms to clean and remove rough surfaces and welding by-products or remnant material from external portions of the pipe joint J. The cleaning head H serves to clean the pipe joint surfaces so that a smooth surface is present for subsequent application of a corrosion resistant coating or film of suitable type in the conventional manner.

Spent abrasive particles and metal and other waste materials removed by the blast cleaning operation are gathered under suction or partial vacuum in the cover head 100 of the cleaning head H and transported by a return line 106 of the cleaning head H through a conduit or connection.

The motor support plate 86 also has arm or lug extensions 110 (FIG. 5) extending outwardly therefrom at suitable locations. The arms 110 serve as limit indicators and are sensed by longitudinal limit sensors 112 mounted at opposite portions on a support rod 114 of the carriage G on each side of the pipeline joint J. The longitudinal limit sensors 112 are mounted at adjustably located positions on the support rod 114 by clamps or other adjustable attachment mechanisms 118 to adjust the longitudinal placement and thus the longitudinal movement of the cleaning head H with respect to the pipe joint J. The longitudinal movement sensors 112 may be optical, metallic, magnetic or other suitable sensors to sense the presences of a corresponding optical, metallic, magnetic or other target located on the arms 110. The longitudinal movement sensors 112 form an indication or signal indicating that a limit of relative longitudinal travel of the cleaning head H in either longitudinal direction with respect to the pipe joint J has been obtained.

When the longitudinal limit sensors 112 sense the limit of relative longitudinal travel, an indication or signal is provided over conductors 115 to the control mechanism C to stop operation of the motor M. At such time, the directional limit of longitudinal travel of the cleaning head H during a longitudinal cleaning movement with respect to the pipe joint J has been achieved. The position of the cleaning head H and the frame F with respect the pipe joint J can then be adjusted so that a new longitudinal cleaning movement may begin.

Figure 8:
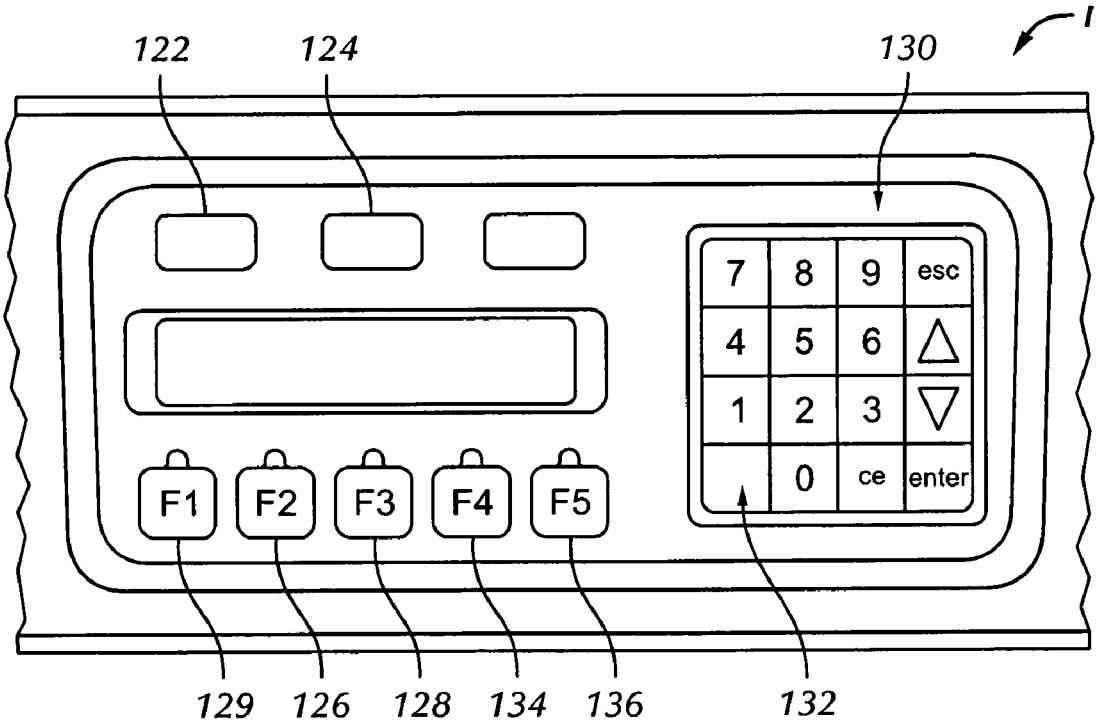
FIG. 8 is an elevation view of a control panel in the input/output unit of the control system of FIG. 6.
Figure 9:
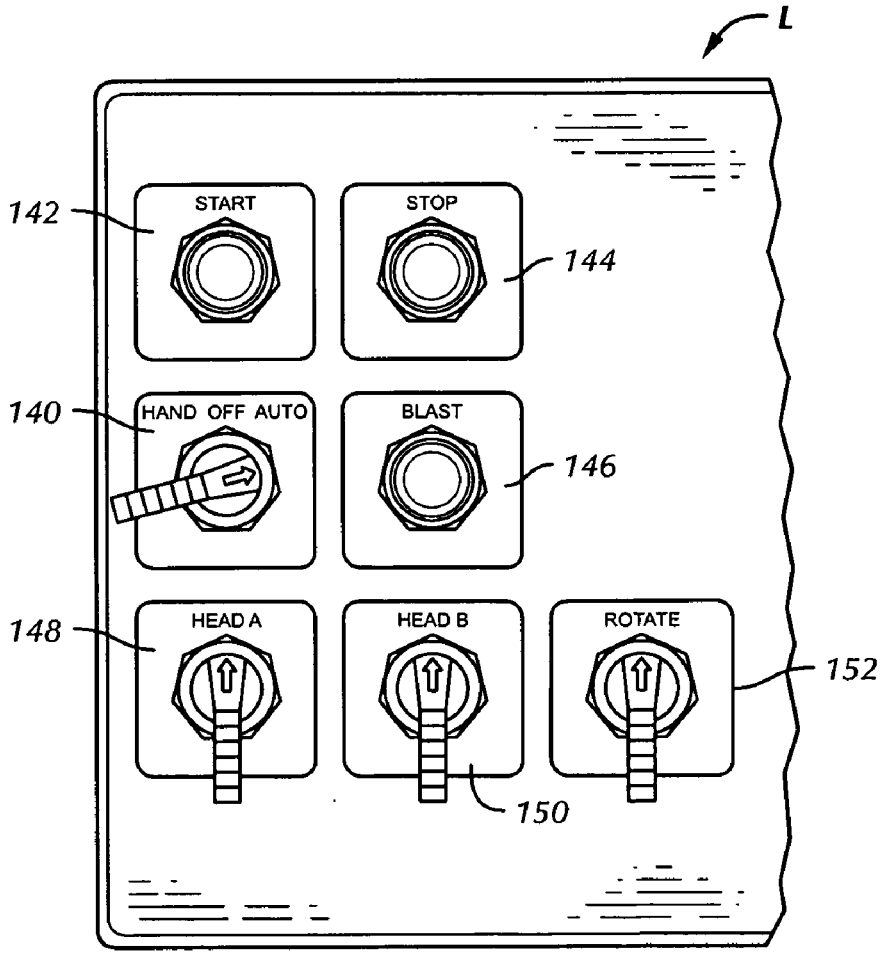
FIG. 9 is an elevation view of control switches of the control system of FIG. 6.

The controller C controls operation of the machine M based on settings provided by an operator at an input/output unit I (FIG. 8) and a control switch panel L (FIG. 9). The controller C may be a programmable logic controller or PLC, of any suitable commercial type, such as a Model D4-450 CPU from Koyo Electronics Industries Co., Ltd. of Tokyo, Japan. The controller C can also take the form of other process control apparatus or computers, such as a personal computer, laptop computer or other form of computer, with appropriate interface or signal conditioning circuits to the encoders, sensors and motors of the machine M. The controller C, unit I and panel L are preferably located in an enclosure for protection from conditions on the deck of the pipe barge. As is conventional, the controller C is provided with an uninterrupted power source or UPS for protection against power transients or surges.

The input/output unit I (FIG. 8) includes a control input button 120 which allows an operator to select whether the cleaning head is to be active in cleaning the pipe joint J in only one direction of longitudinal scan or movement of the carriage head H with respect to the pipe joint J, or in both longitudinal directions or scans. An indicator or light 122 in the unit I is energized when bi-directional longitudinal cleaning passes are selected. An indicator or light 124 in the unit I is energized when, in the alternative, only one direction of longitudinal cleaning passes or scans are selected. A screen or display panel or other suitable alphanumeric indicator 125 is provided in the unit I to allow an operator of the machine M to receive messages from the PLC of or the controller C to view instruction codes or settings sent to the PLC.

A control input button 126 allows an operator to select the amount or increment of each rotational step of the support yokes 34 and 40 with respect to the mounting rings 20 and 22 between longitudinal scans. As noted above, the longitudinal scans are set to be either one-directional or bi-directional by input button 120. In this way, the cleaning heads H move in a raster-like scan of longitudinal movements or passes along the pipe joint J in the direction of the longitudinal axis 16. A control input button or key 128 is provided in the unit I to allow an operator to identify to the controller C the position of a home position or starting position for the support yokes, carriage head and other structure of the frame F is to be provided. The values or codes defining the starting position may then be entered through a keypad 130 with numerical selected keys 132.

Similarly, a control input button or key 134 is provided to allow an operator to notify the controller C of an end point or furthest position the support yokes are to move with respect to the mounting rings. This serves to define final position of the moveable components of the frame F. The values or codes defining the end point are entered thru the selected keys 132 of the keypad 130. A control input key 136 is provided to notify the controller C of the amount of time which elapses after the machine M is activated for cleaning operations, and before the activation of the blast head B begins. The amount of time can be entered by way of selected key 132.

The control switch panel L (FIG. 9) includes a control switch 140 which has three settings, an OFF position the cleaning apparatus to an off or deactivated position; an AUTO position where blast cleaning operations proceed automatically under the control of the controller C; and a HAND position for allowing the operator to manually control the operation of the blast cleaning head H. The mode control switch 140 must be in the AUTO position before position of the start button 142 is able to begin operation of any cleaning cycle. The control switch panel L also includes a start button 142, which allows the operator to start the automatic cycle operation when the mode control switch 140 is in the AUTO position. The control switch panel L further includes a stop control button 144, which stops the machine at any current position of its operating cycle and returns the machine M to the home position. The control switch panel L also includes a blast control switch 146, which activates the operation of the blast cleaning head.

A movement control switch 148 of the control switch panel L allows an operator to move a first of the cleaning heads to the left or right as desired. Similarly, a movement control switch 150 of the control switch panel L allows an operator to move the other of the two cleaning heads to the left or right, as desired. Finally, a control switch 152 of the control switch panel L allows an operator to select the direction of rotation the support yokes 34 and 40 with respect to the mounting rings 20 and 22, namely either counter clockwise or clockwise, as desired.

From the foregoing, it can be seen that the machine M is safe, efficient, reliable and clean in operation. There is no wrapping about the pipe joint J of the supply hoses, due to the raster scan movements of the cleaning heads H. The machine M can be controlled and operated by a single operator and fully automatic. There is also no need for contact with the machine M while it is in operation.

In the operation of the present invention, using for example an automatic double pass of the cleaning head H, the mounting rings 20 and 22 are lowered onto the pipe joint J. The mounting rings 20 and 22 are centered on the pipe joint J using the spacer blocks or stand offs 26.

The start button 142 is then pressed. The support yokes 34 and 40 rotate until proximity switch 70 opens, stopping the rotation and resetting the encoder mechanism 66 to zero. The cleaning heads H move longitudinally until limit sensors 112 at one end of the carriage G sense the presence of extensions 110 on the support plate 86 and close. The controller C then stops longitudinal movement of the cleaning heads H on the carriage G.

The switch 146 is then activated, starting the flow of blast media from the blast machine. When proximity sensor 70 is open and proximity sensors 112 are closed the blast delay timer begins. At the end of the blast delay, motors 84 are activated by the controller C. The cleaning heads H begin to move longitudinally along the pipe joint J, applying abrasive particles or otherwise cleaning the pipe joint. When the support plate 86 for one of the moving cleaning heads H nears a proximity sensor 112 at the end of a first directional longitudinal scan, the controller C causes the motor 84 for that cleaning head to stop and then reverse direction. The same procedure is followed for the other cleaning head H at the completion of its first directional cleaning scan, although it need not occur at the same time.

The cleaning heads H then each begin movement in a return or reverse direction to the first directional scan, moving over the pipe joint J during their reverse travel, cleaning the pipe joint J. For bidirectional cleaning movement, the cleaning heads H clean the pipe joint J in each direction of their longitudinal movement. As noted, the cleaning activity for one cleaning head H may also be set to occur only during one direction of movement, if desired. Movement in the reverse or return direction continues until the proximity sensors 112 inform the controller C that a full cycle of a first directional scan and a return or reverse longitudinal scan is completed. At the end of one full cycle of travel as detected by proximity sensors 112, the controller C activates the motors 50. The motors 50 then move the support yokes 34 and 40 with respect to the mounting rings 20 and 22 by an incremental amount of rotational travel which is set into the controller C by step count input switch 126. After rotation by the established amount, the cleaning heads H perform another cycle of longitudinal scans along the pipe joint J. The cleaning heads H continue cycles of back and forth movements, and rotation between cycles, until the end count set by input switch 134 is reached. At this time, the pressure supply to the cleaning heads H disengages and the support yokes 34 and 40 return to their home position on their respective mounting rings 20 and 22. The machine M can then be lifted and the pipe advanced to move the pipe joint J for a protective coating to be applied.

It should be noted and understood that there can be improvements and modifications made of the present invention described in detail above without departing from the spirit or scope of the invention as set forth in the accompanying claims.

What is claimed is:

1. A pipe weld cleaning machine to clean a metal pipe joint formed at end portions of longitudinally extending joined sections of coated pipe, comprising:

a cleaning head to clean the pipe joint between the coated sections;

a frame for mounting the cleaning head in a position disposed for repetitive longitudinal cleaning movements along the pipe joint during cleaning, the frame having a cleaning head carriage for supporting the cleaning head during longitudinal cleaning movements;

a controller for controlling longitudinal movement and position of the cleaning head with respect to the pipe joint;

limit sensors for sensing longitudinal movement limits of the cleaning head with respect to the pipe joint and providing signals to the controller indicating a longitudinal movement limit is reached; and a motor for moving the cleaning head on the frame longitudinally of the pipe joint during the longitudinal cleaning movements.

2. The pipe weld cleaning machine of claim 1, wherein the cleaning head comprises a blast applicator head for applying abrasive particles to clean the pipe joint; and a return line for extracting abrasive particles and material from the pipe joint.

3. The pipe weld cleaning machine of claim 1, wherein the frame comprises:

first and second mounting rings located at longitudinally spaced positions from each other on the pipe adjacent the metal pipe joint.

4. The pipe weld cleaning machine of claim 3, wherein the frame further comprises:

first and second support yokes, each support yoke being rotatably mounted with an associated one of the first and second mounting rings and adapted for rotatable circumferential movement with respect to the pipe joint and the associated mounting ring.

5. The pipe weld cleaning machine of claim 4, further including:

a motor mounted with each of the mounting rings for rotatably moving the support yoke with respect to the mounting ring.

6. The pipe weld cleaning machine of claim 5, further including:

limit sensors for sensing rotational movement limits of the support yokes with respect to the mounting rings.

7. The pipe weld cleaning machine of claim 6, further including:

a controller for controlling movement and position of the cleaning head with respect to the pipe joint.

8. The pipe weld cleaning machine of claim 7, wherein:

the limit sensor senses rotational limits of the cleaning head with respect to the pipe joints and provides signals to the controller indicating a rotational limit is reached.

9. The pipe weld cleaning machine of claim 5, further including:

a position encoder forming an indication of the relative position of the support yokes with respect to the mounting rings.

10. The pipe weld cleaning machine of claim 9, further including:

a controller for controlling movement and position of the cleaning head with respect to the pipe joint.

11. The pipe weld cleaning machine of claim 10, wherein:

the position encoder provide a signal to the controller indicating relative position of the support yokes with respect to the mounting rings.

12. A pipe weld cleaning machine to clean a pipe joint formed at welded end portions of longitudinally extending joined sections of weight coated pipe, comprising:

a cleaning head to clean the pipe joint;

a frame for mounting the machine on the pipe at the pipe joint, a carriage for mounting the cleaning head on the frame;

a controller for controlling movement and position of the cleaning head on the carriage;

sensors for sensing the position of cleaning head on the carriage; and a motor for moving the cleaning head with respect to the carriage longitudinally of the pipe during the longitudinal cleaning movements.

13. The pipe weld cleaning machine of claim 12, wherein the sensors include:

limit sensors for sensing movement limits of the carriage with respect to the frame.

14. The pipe weld cleaning machine of claim 13, wherein:

the limit sensor senses rotational limits of the cleaning head with respect to the pipe joints and provides signals to the controller indicating a rotational limit is reached.

15. The pipe weld cleaning machine of claim 12, wherein the sensors include:

limit sensors for sensing movement limits of the cleaning head with respect to the carriage.

16. The pipe weld cleaning machine of claim 12, further including:

a position encoder forming an indication of the position of the carriage with respect to the frame.

17. The pipe weld cleaning machine of claim 16, wherein:

the position encoder provides a signal to the controller indicating relative position of the position of the carriage with respect to the frame.

18. A pipe weld cleaning machine to clean a metal pipe joint formed at end portions of longitudinally extending joined sections of coated pipe, comprising:

a cleaning head to clean the pipe joint between the coated sections;

a frame for mounting the cleaning head, the frame having first and second mounting rings located at longitudinally spaced positions from each other on the pipe adjacent the metal pipe joint, the cleaning head mounted in a position disposed for repetitive longitudinal cleaning movements between the first and second mounting rings along the pipe joint during cleaning;

a controller for controlling longitudinal movement and position of the cleaning head with respect to the pipe joint;

limit sensors for sensing longitudinal movement limits of the cleaning head with respect to the pipe joint and providing signals to the controller indicating a longitudinal movement limit is reached; and a motor for moving the cleaning head on the frame longitudinally of the pipe joint during the longitudinal cleaning movements.

* * * * *